US005101974A

United States Patent [19]

Alwitt

[11] Patent Number: 5,101,974

[45] Date of Patent: Apr. 7, 1992

[54] SELF-LATCHING CAMERA CASE

[76] Inventor: Phil Alwitt, 263 Arkansas St., San Francisco, Calif. 94107

[21] Appl. No.: 627,715

[22] Filed: Dec. 14, 1990

[51] Int. Cl.[5] ..... B65D 85/38

[52] U.S. Cl. ..... 206/316.2; 224/207

[58] Field of Search ..... 206/316.1, 316.2, 316.3; 150/154; 224/202, 203, 207, 908

[56] References Cited

U.S. PATENT DOCUMENTS

| | | | |
|---|---|---|---|
| 1,532,312 | 4/1925 | Hoskins | 206/316.2 |
| 4,000,769 | 1/1977 | Katz | 206/316.2 |
| 4,033,392 | 7/1977 | Less | 206/316.2 |
| 4,162,696 | 7/1979 | Sprung | 206/316.2 |
| 4,176,701 | 12/1979 | Welgan | 206/316.2 |
| 4,232,808 | 11/1980 | Gray | 206/316.3 |
| 4,549,589 | 10/1985 | Nguyen | 206/316.2 |
| 4,601,318 | 7/1986 | Diegelman | 206/316.2 |
| 4,649,973 | 3/1987 | Uchin | 224/207 |
| 4,927,017 | 5/1990 | Easter | 206/316.2 |
| 4,982,841 | 1/1991 | Goedecke | 206/316.2 |

FOREIGN PATENT DOCUMENTS

| | | | |
|---|---|---|---|
| 0218378 | 11/1961 | Austria | 206/316.2 |
| 2061691 | 6/1972 | Fed. Rep. of Germany | 206/316.2 |
| 2226721 | 12/1973 | Fed. Rep. of Germany | 206/316.2 |
| 0447123 | 11/1949 | Italy | 206/316.2 |
| 0985184 | 3/1965 | United Kingdom | 206/316.2 |

*Primary Examiner*—Jimmy G. Foster

*Attorney, Agent, or Firm*—Kenneth M. Goldman

[57] ABSTRACT

A reversible, deformable camera carrying case is disclosed wherein the latch for closing the case is inherent in the case material in the form of an aperture. A clipping device attached to the case to ensure the camera is not separated from the case is also disclosed.

8 Claims, 1 Drawing Sheet

SELF-LATCHING CAMERA CASE

FIELD OF THE INVENTION

The present invention relates generally to the field of carrying cases, more particularly to a camera carrying case. The invention further relates to an invertible camera case with the latch for closing the case inherent in the case material itself.

BACKGROUND ART

Camera carrying cases are well known in the field of photographic equipment. Most effective carrying cases provide a protective shell for the camera when not in use. These cases are designed so that the camera in its case may be carried by a strap around the user's neck, and so that the case remains attached to both user and camera while the camera is in use.

These cases also provide some method for fastening the case in a closed position when the camera resides the case. U.S. Pat. No. 4,917,241 to Hanson discloses a two-piece case having a separate covering for the lens, and fastened by Velcro. U.S. Pat. No. 4,649,973 to Uchin discloses an "ever-ready" camera case wherein a flexible case is interlocked with a camera strap to prevent case misplacement. The Uchin case is fastened shut with a zipper. U.S. Pat. No. 4,928,819 discloses an air permeable camera case, fastened shut with an adhesive such as Velcro.

U.S. Pat. No. 4,601,318 to Diegelman discloses a camera case having separate camera-enclosing and lens enclosing portions, joined by a ring assembly and fastened shut with zippers. U.S. Pat. No. 2,938,441 to Klingenstein discloses a snap-fastened camera case with a chart selector. U.S. Pat. No. 2,323,053 to Kupferschmid discloses a soft camera pouch fastened shut by zippers. West German Patent No. 1,155,321 to Croy discloses a snap-fastened camera case with a separable lens portion.

Cases fastened shut by Velcro, snaps, zippers and other auxiliary fasteners have many drawbacks. Although they can be fashioned from flexible and resilient materials, the location of the fasteners make them non-invertible or "one-way" cases. The fasteners are also an additional manufacturing expense, and may be difficult to operate, and eventually may jam or break down rendering the case nonclosable and of limited use. Furthermore, the fixed location of the fastener in some instances restricts the use of the case to cameras of a particular size or configuration.

SUMMARY OF THE INVENTION

The present invention overcomes the drawbacks of the prior art, by protecting the camera with a case of flexible, deformable material with a latch included in the material in the form of an aperture that slides over the case-covered lens portion of the camera. The resiliency and deformability of the material is such that one case size will fit most cameras. The case is also of unitary construction, in that the cover and body of the case are continuous, minimizing assembly time and costs. A clipping device attached to the case ensures that the case is never separated from the camera, and, when the camera is held by its user with a strap, that the case is never separated from the user.

It is accordingly a primary object of the present invention to provide a camera protective case of a flexible, deformable material, wherein the case is latched by means of an aperture in the cover which slides over the lens.

It is a further object of this invention to provide a camera protective case of a flexible, deformable material, wherein the case is reversible.

It is another object of this invention to provide a reversible camera protective case of a flexible material, capable of attaching to the camera and user to prevent loss.

Additional objects, advantages and novel features of the invention will be set forth in part in the description which follows, and in part will become apparent to those skilled in the art upon examination of the following, or may be learned by practice of the invention.

In one aspect of the invention, a camera protective case of unitary construction is provided comprising a flexible, deformable hollow body having contours corresponding generally to the contours of a camera to be carried therein and having an open end through which a camera may be inserted and removed, forming an outer surface and a pocket to receive the camera; and a flexible, deformable cover extending from the open end of the body at the rear, and capable of moving between first and second positions in which, respectively, the cover closes and opens the end of the body, the cover having a single aperture sized to permit entry of the lens portion of the camera when the camera is disposed in the pocket.

In another aspect of the invention, the above-described camera protective case is provided, wherein the case is invertible and further comprises one or two clipping devices capable of attaching to the camera.

DETAILED DESCRIPTION OF THE INVENTION

As used herein, the term "camera" refers to a piece of photographic equipment having a generally rectangular body and a lenspiece extending outward from the front of the body.

As used herein, the term "unitary construction" or "unitary composition" refers to an object that, although it may be manufactured from one or more pieces of material, has no well-defined boundaries, so that it is impossible to determine where one portion or component of the object ends and the next begins In the camera case of this invention, for example, the cover and body of the case are made of continuous material, and there is no distinct boundary between the two portions.

Figure 1:
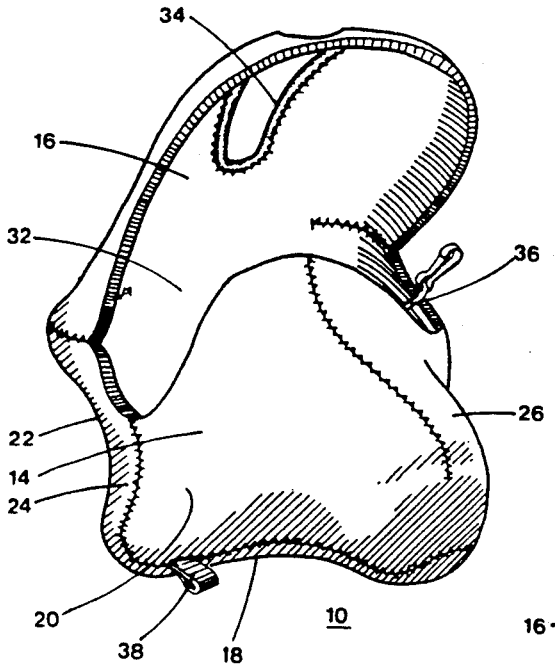
FIG. 1 is a perspective view of a camera protective case in accordance with the invention.
Figure 2:
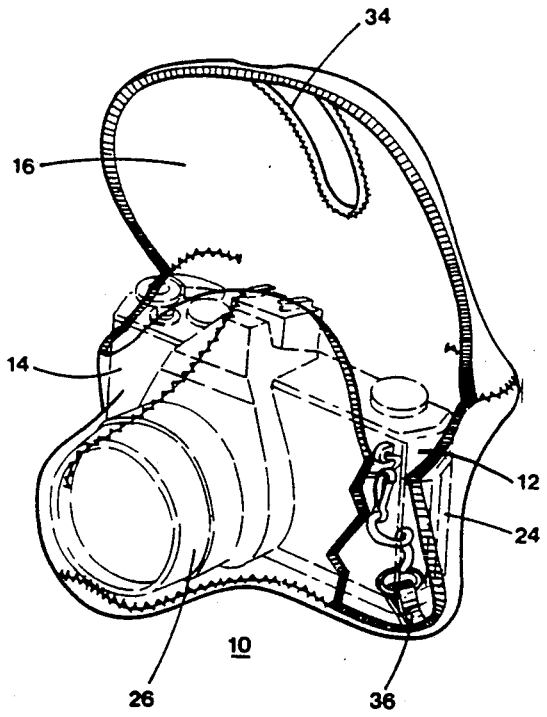
FIG. 2 is a perspective view of the case with the camera disposed in the pocket and the cover open, with a cutaway section exposing the clip attachment.
Figure 3:
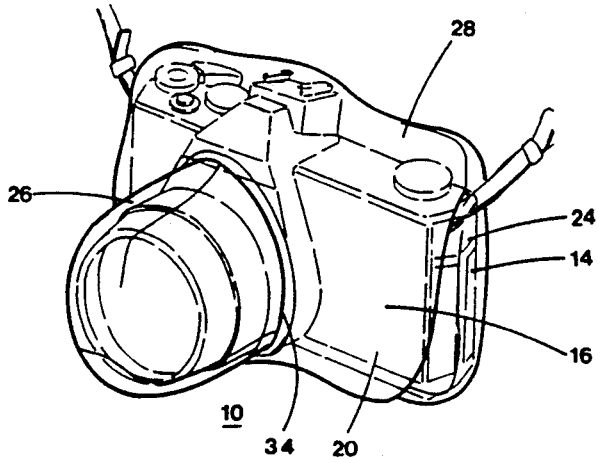
FIG. 3 is a perspective view of the case with the camera disposed in the pocket and the cover closed. The camera is shown with a shoulder strap attached.

In FIG. 3, the camera protective case 10 is illustrated fully protecting the camera 12 when the camera is not in use. The protective case 10 is of unitary composition, and comprises main body housing 14, which provides a housing for the complete camera 12, and cover 16.

Main housing 14 has contours which correspond generally to the contours of a camera to be carried therein. Although the housing is of unitary construction, it may be considered to have a floor 18, front 20 and rear panels 22, sides 24, lenspiece 26, and top 28.

The housing has an open pocket 32 through which a camera may be inserted in and removed from housing 14.

Cover 16 extends from the main housing 14 at the top of rear panel 22. Cover 16 contains aperture 34 disposed near the center. Aperture 34 may be of any shape or size as long as it is deformable to a position permitting entry of the lenspiece 26 and the part of floor 18 underlying lenspiece 26 when the camera is disposed in pocket 32. When aperture 34 is engaged by entry of lenspiece 26 and floor 18, the aperture fits snugly over the lens and the case is closed by the "latch" so formed, as seen in FIG. 3.

In the preferred embodiment of this invention, body 14 and cover 16 are made of resilient, deformable, waterproof material, most preferably both are made of the same material. Examples of such materials are elastic polymers including neoprene rubber, Hypolon®, or neoprene rubber with laminated nylon on one or both sides.

The resilient, deformable nature of the material and the unitary construction of the case permits the case to be easily reversible or invertible, so that pocket 32 becomes the outer surface of body housing 14 and vice versa. Reversibility permits the user to change at will the color, texture, or other qualities of the outer surface of the case.

It will be seen that the "latching" function works equally well in the normal and inverted states. The deformable nature also permits the body to deform into a variety of shapes, so that the case is of the "one size fits all" variety.

At this point it may be noted that as another feature, this invention consists of a clipping device 36 attached to pocket 32. This clipping device is capable of attaching to the camera in one of the upper camera body corners where a camera strap usually attaches. When clipping device 36 is attached to the camera, it ensures that case 10 remains attached to the camera after the camera has been removed from the case. If the camera user is holding the camera by means of a camera strap, then the clipping device further ensures that the user does not lose the case.

The invention may further consist of another clipping device 38 attached to the outer surface of body 14. This second clipping device serves the same function as clipping device 36 when case 10 is inverted. In a preferred embodiment, the two clipping devices consist of two fabric loops and a removable metal clip that may be transferred to either loop depending on the configuration of the case.

While particular embodiments of this invention have been shown in the drawings and described above, it will be apparent that many changes may be made in the form, arrangement and positioning of the various elements of the combination. Therefore it should be understood that preferred embodiments of this invention disclosed herein are intended to be illustrative only and not intended to limit the scope of the invention.

I claim:

1. A camera protective case of unitary construction comprising:

a flexible deformable hollow body having an inner and outer surface and having contours corresponding generally to the contours of a camera to be carried therein, said body having an open end adapted to receive said camera therein, said body including a front portion having a hollow lenspiece adapted to receive and cover a lens of said camera when said camera is received in said body, said body including a rear portion opposite from said lenspiece; and a flexible deformable cover extending from said rear portion, and capable of moving from a closed position in which said cover closes said open end and overlaps said front portion to an open position in which said cover opens said open end and uncovers said front portion, said cover including an aperture adapted in the closed position for receiving said lenspiece and camera lens therethrough.

2. The camera protective case of claim 1 wherein the body is deformable to permit the case to be inverted so that the outer surface of the case becomes the inner surface and the inner surface becomes the outer surface.

3. The camera protective case of claim 2 wherein the cover is of the same material as the body.

4. The camera protective case of claim 3 wherein the material is an elastic polymer.

5. The camera protective case of claim 3 wherein the elastic polymer is selected from the group consisting of neoprene and Hypolon.

6. The camera protective case of claim 3 further comprising a protective layer of laminated nylon on at least one surface of the case.

7. The camera protective case of claim 2 further comprising a first clipping device attached to the body in the pocket and capable of attaching to the camera.

8. The camera protective case of claim 7 further comprising a second clipping device attached to the body on the outer surface and capable of attaching to the camera when the case is inverted.

* * * * *